US006223580B1

(12) United States Patent
Kirby

(10) Patent No.: US 6,223,580 B1
(45) Date of Patent: May 1, 2001

(54) METHOD AND APPARATUS FOR CONTINUOUS MONITORING AND AMPLITUDE ADJUSTMENT OF ADJUSTABLE LENGTH HEATING ELEMENT

(76) Inventor: Robert L. Kirby, Rte. 7 Hwy. 70 East, Sparta, TN (US) 38583

( * ) Notice: Subject to any disclaimer, the term of this patent is extended or adjusted under 35 U.S.C. 154(b) by 0 days.

(21) Appl. No.: 09/477,428

(22) Filed: Jan. 4, 2000

Related U.S. Application Data

(63) Continuation-in-part of application No. 09/072,671, filed on May 6, 1998, now abandoned.

(51) Int. Cl.[7] ..... B21C 37/02
(52) U.S. Cl. ..... 72/379.6; 72/196
(58) Field of Search ..... 72/379.6, 370.19, 72/379.2, 377, 196, 187

(56) References Cited

U.S. PATENT DOCUMENTS

| | | | | |
|---|---|---|---|---|
| 3,086,187 | | 4/1963 | Duggan et al. . | |
| 4,311,034 | * | 1/1982 | Hall et al. | 72/379.6 |
| 4,838,067 | * | 6/1989 | Cornelison | 72/196 |
| 5,393,958 | | 2/1995 | Gross et al. . | |

* cited by examiner

*Primary Examiner*—Rodney A. Butler
(74) *Attorney, Agent, or Firm*—Patton Boggs LLP

(57) ABSTRACT

A method and apparatus for forming a heating element by corrugating a ribbon to a waveform having an amplitude based on a measured resistance per unit length of the ribbon. The amplitude of the corrugation is varied based on the measured resistance, to vary the actual path length of the heating element, shorter based on higher resistance and longer based on lower resistance. The heating element is formed to have a predetermined length dimension. The apparatus comprises a pair of intermeshed gears, with the spacing controlled in accordance with the measured resistance per unit length of the unformed ribbon.

9 Claims, 4 Drawing Sheets

METHOD AND APPARATUS FOR CONTINUOUS MONITORING AND AMPLITUDE ADJUSTMENT OF ADJUSTABLE LENGTH HEATING ELEMENT

This is a continuation-in-part application of application Ser. No. 09/072,671, now abandoned filed May 6, 1998, entitled "Adjustable Length Heating Element for Range Top".

BACKGROUND OF THE INVENTION

The present invention relates to a method and apparatus for forming a heating element to have a predetermined resistance and, more particularly, for forming a corrugated heating element to a predetermined resistance and a predetermined overall length, regardless of variations in the resistance per unit length of the pre-formed ribbon, by monitoring the ribbon resistance and varying the amplitude of the corrugations based that per unit length resistance.

Resistive heating elements are commonly used to generate heat based on the flow of electric current. The amount of heat that the element generates, in terms of watts, is determined by the resistance it offers to the flow of current. The resistance is determined by the material from which the element is made and on the element's dimensions. For a given material, resistance is directly proportional to the element's length and inversely proportional to its cross sectional area. The wattage of the heat produced is equal to the element's resistance, in Ohms, multiplied by the square of the current, in amps, flowing through the element. The wattage can also be calculated in terms of the voltage drop across the element, where it is the square of the voltage across the element divided by its resistance.

Heating elements find application in many industrial processes and are also used in the home. In some applications, it is important to be able to control the characteristics of the element and the energy produced thereby. For example, when a heating element is placed beneath a protective glass-ceramic cover, such as those found on many cooking surfaces, the wavelength at which the element radiates is important because such covers are not transparent to all wavelengths. To maximize the amount of radiation that passes through the cover a heating element must be designed to emit the majority of its energy at wavelengths to which such covers are transparent.

Adjusting the amount of heat produced by a heating element, i.e., adjusting the wattage, is accomplished by changing the current through the element, or by changing the resistance of the element The resistance is changed by varying the length or cross-sectional area of the element, by forming the element from materials having different resistivities. In practice, however, certain materials are used for heating elements because of their durability, price, and other qualities and thus the resistivity of a heating element will be fixed for many applications. Likewise when the heating element is required to produce a certain amount of power at a given voltage, it may not be practicable to control the current. Therefore, the desired heat output is most easily obtained by adjusting the resistance of the element, and this in turn is done by properly selecting the length and cross sectional area of a resistive heating element.

As summarized above, the wavelength of the energy produced by the heating element depends on its operating temperature. The wavelength is generally specified to meet the wavelength-dependent heat opacity and reflectivity characteristics of the structures that will surround the heating element. The operating temperature, in turn, is a function of the dimensions of the heating element and its wattage. It is a function of the dimension because a large element dissipating a given wattage will generally have a lower operating temperature than a small element dissipating the same wattage, assuming the two are made of the same material.

The wattage of the heating element is generally a specified parameter, as this is heat generating capacity of the element. Wattage depends on resistance and voltage and, in general, voltage is a predetermined quantity. Therefore, from the required wattage and voltage, the resistance necessary to generate that wattage is calculated. Resistance is a function of the material and the dimension of the element. The material is selected based on cost, operating temperature, operating environment, and special considerations, such as corrosive atmosphere, vibration and the like. The cross-sectional area of the element is generally pre-specified according to the size and mounting structure of the heating element. Therefore, after the resistance is calculated the designer determines the length of element needed to produce a given resistance.

Once the necessary length of material has been obtained, the designer must arrange the element in some configuration, within a defined area in a heating unit, so that it will produce a given distribution of heat. The distribution may be even or may vary in a particular way. Unfortunately, the best pattern for heat distribution purposes may be shorter than the length of the heating element needed to produce the desired power output. The designer must therefore compromise the layout that would have been optimal from the standpoint of heat distribution alone, and engage in the generally time consuming practice of finding alternate but still acceptable pathways for laying out the fixed length of heating element.

Assuming that the alternate layout pattern can be found, there is an additional problem arising from variations in the resistance per-unit length of the material. The problem is that the length calculated for achieving the desired resistance, and hence wattage, does so only for a material having the exact resistance per unit length for which the length was calculated. However, if a new batch of heating element material is procured having a resistance per unit length, for example, that is 1% lower than the material for which an acceptable layout was found, then a heating element made from the new material will have 1% lower resistance than the prior one. A 1% variation in wattage, however, may be unacceptable.

A solution known in the prior art would be to increase the length of the element formed of the new material by 1%. There are at least two problems arising from this solution. One is the time required to measure the resistance per unit length of each batch of heating element material and then adjust the length accordingly. The other is that changing the length of the finished element by 1% may cause mounting problems. A one percent change in overall physical dimension could cause fitting or clearance problems or, if mounting points were at specific locations on the element patterns, could cause misalignments.

SUMMARY OF THE INVENTION

The present invention solves the problem of batch-to-batch variation in resistance per unit length of the heating element material without incurring either of the above-identified problems of varying the element's length. The invention accomplishes this objective by forming a length of material, by bending or otherwise, into a corrugated waveform where the total length of the element is determined by the shape, pitch and amplitude of the formed corrugations or waves. The overall physical length of the element, though, is fixed. Therefore, by varying the amplitude of the corrugations the actual path length of the element can be varied, while its overall physical length remains constant. Still further, the shape of the corrugations or convolutions can be selected by changing the form or arrangement of the tool used to form the convolutions in the element. This will have an effect on the length of the element. Accordingly, using the method of the subject invention, a designer is provided with several ways to alter the path length of a heating element and hence attain a desired resistance, while maintaining the overall physical length of the element to a given standard.

The present invention contemplates various devices for forming heating elements with desired pitches and amplitudes from ribbons of resistive material. One example embodiment passes the ribbon between the intermeshed teeth of two gears to bend it into a waveform made up of a number of wavelets, wherein each wavelet is the portion of the waveform between any two adjacent points at which the waveform crosses its longitudinal axis. Using this method, the radius of curvature of each wavelet in the waveform will be determined by the shape of the outer portion of each gear tooth, and the pitch of the waveform will be approximately equal to the pitch of the gears. The amplitude of the waveform can be adjusted by varying the separation between the gears.

A second example embodiment combines the intermeshed gear apparatus of the first example embodiment with a resistance measurement device and an amplitude controller. At least one of the two intermeshed gears is mounted to a servo mechanism which moves that one gear closer or further from the other gear, thereby varying the degree by which the teeth of the two gears are intermeshed. The servo mechanism is controlled by the amplitude controller. The resistance measurement device measures the resistance per unit length of the ribbon material before it is fed between the intermeshed gear teeth. A signal from the resistance measurement device is input to the amplitude controller. An output signal from the amplitude controller is input to the servo mechanism. The amplitude controller is adjusted to place the two gears at a predetermined nominal spacing if the measured resistance of the unformed ribbon is equal to a predetermined nominal value. The predetermined nominal spacing in turn results in a standard amplitude of the element corrugations. The standard amplitude forms a heating element having a length which will achieve the desired resistance if the ribbon has its nominal resistance per unit length. However, if there is any detected deviation between the measured resistance of the unformed ribbon and its nominal resistance the amplitude controller varies its signal to the servo accordingly. The amplitude controller automatically controls the servo, based on the measured resistance of the unformed ribbon, to move the gears closer together if the measured resistance per unit length is lower than the nominal value Similarly, the amplitude controller moves the gears further apart if the measured resistance of he unformed ribbon is higher than the nominal value. Accordingly, when the measured resistance is lower than the nominal value, the amplitude of the corrugations of the formed heating element is larger than the nominal amplitude. This increases the actual length of the heating element, meaning the path length, to the length that will obtain the target resistance and thus compensates for the lower resistance per unit length of the unformed heating element ribbon, without increasing its overall physical dimension. Similarly, when the measured resistance is higher than the nominal value, the amplitude of the corrugations of the formed heating element is lower than the nominal amplitude. This decreases the path length of the heating element to obtain the target resistance, and thus compensates for the lower resistance per unit length of the unformed heating element ribbon, again without increasing or decreasing its overall physical dimension.

Another method according to the present invention uses a plurality of forming pins to form each individual wavelet in the waveform. The pins are arranged in rows parallel to the element on either side thereof, and pulled against the element in opposite directions. The radius of curvature is based on the radius of each pin, the pitch on the spacing between the pins in a row, and the amplitude on how far the pins are pulled along their channels during the forming process.

It is another object of the present invention to provide a method for forming a heating unit having a desired power output and power output pattern.

It is still another object of the present invention to provide a method for increasing the number of power output patterns obtainable using a given length of heating element material.

It is still a further object of the present invention to provide a method of forming a heating element for producing a given heat output into a desired shape.

BRIEF DESCRIPTION OF THE DRAWINGS

These and other objects will become apparent from a reading and understanding of the following detailed description of a preferred embodiment of the invention together with the following drawings of which.

DETAILED DESCRIPTION OF THE PREFERRED EMBODIMENTS

Figure 1:
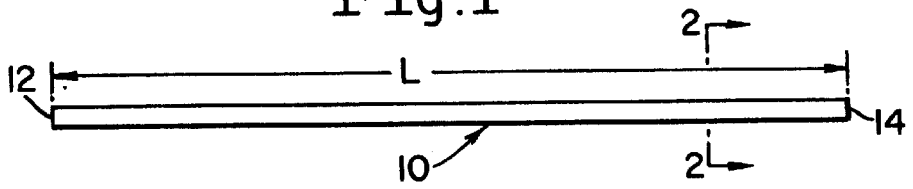
FIG. 1 is a side elevation view of a first portion of heating element material.
Figure 2:
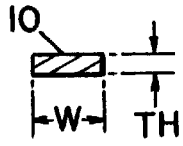
FIG. 2 is a sectional elevation view taken through line 2—2 in FIG. 1.

Referring now to the drawings, wherein the showings are for the purpose of illustrating a preferred embodiment of the subject invention only and not for purposes of limiting same, FIG. 1 shows a resistive heating element 10 having a first end 12, a second end 14, a surface length L, a thickness TH and a width W. Element 10 has a rectangular cross section, the area of which is equal to the product of thickness TH and width W. The resistance R of this element is given by the formula:

$$R=\rho(L/A)$$

where:

ρ=the resistivity of the material used in the element;

L=the length of the element over its surface; and,

A=the cross section of the element, in this case TH×W.

As will be appreciated from the above formula, resistance R is directly proportional to the length L of heating element 10 and inversely proportional to its cross sectional area A.

Figure 3:
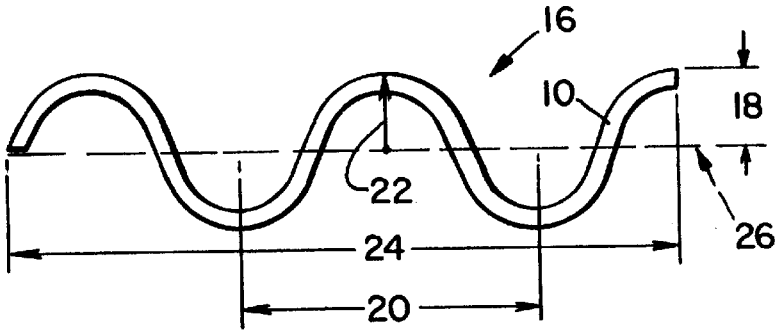
FIG. 3 is side elevation view of the heating element material of FIG. 1 bent into a first waveform.
Figure 4:
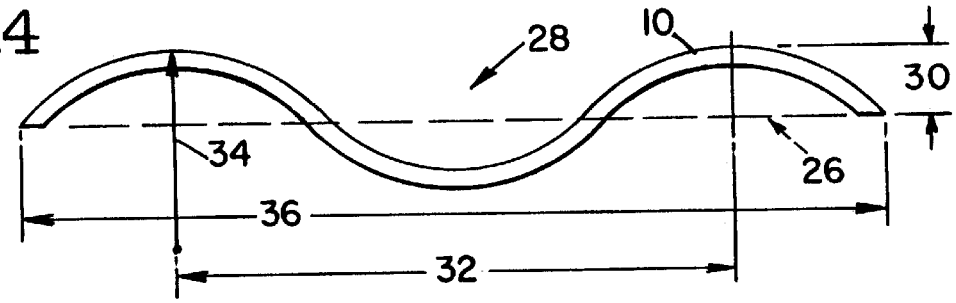
FIG. 4 is a side elevation view of the heating element material of FIG. 1 bent into a second waveform.

Heating element 10 is made from a material that is bendable and which can be shaped into different forms. FIG. 3 shows a first waveform 16 into which the element can be shaped. Waveform 16 is characterized by an amplitude 18, a wavelength or pitch 20, a radius of curvature 22, and a developed or axial length 24. Waveform 16 also includes a longitudinal axis 26 which runs along the longitudinal centerline of the waveform, connecting the two ends thereof. FIG. 4 shows a second waveform 28 into which element 10 can be formed, and this second waveform 28 is characterized by an amplitude 30, a wavelength or pitch 32, a radius of curvature 34, and a developed or axial length 36. The surface length L of element is the same in waveform 16 and in waveform 28. Therefore, the resistance of element 10 is the same whether it is flat as in FIG. 1, or formed into one of the waveforms in FIGS. 3 or 4. The axial length of the elements changes when the pitch and amplitude change, and this property will be useful when attempting to fit the element into a given space.

Figure 5:
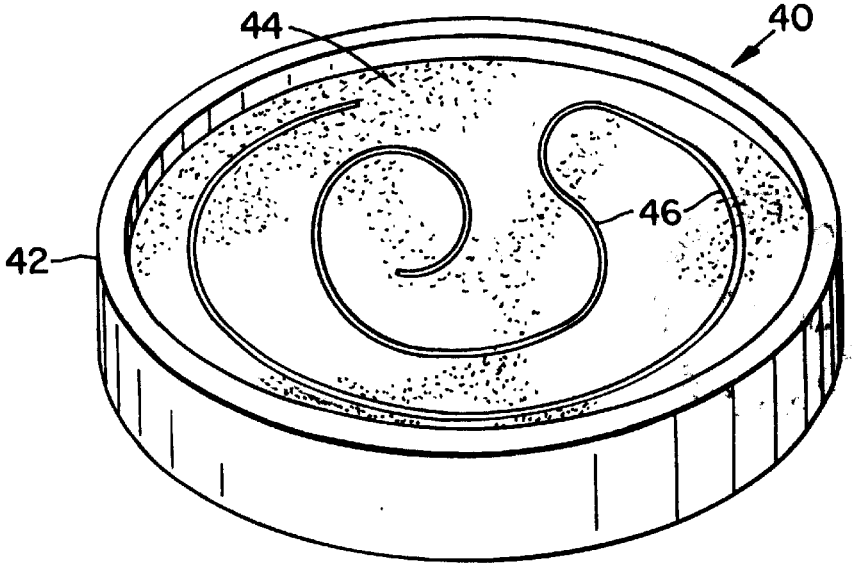
FIG. 5 is a pictorial view of a heating unit including a pathway along which a heating element will be attached.

FIG. 5 shows a heating unit 40 comprising a housing 42, a substrate 44 supported by housing 40, and a pathway 46 in substrate 44 for holding resistive heating element 10.

The shape of pathway 46 determines the heat output pattern that will be produced by unit 40 and this shape is carefully developed by designers so that the heating unit will have specific characteristics. The designer is required to work within a number of constraints when developing the shape of pathway 46, and one of these constraints is the length of the heating element that must be used. Because the length of the element cannot be altered without affecting its characteristics, the designer is very limited in the number of acceptable patterns that can be developed, and it is often impossible to use what would otherwise be a very desirable heat output pattern because the heating element is too long to be formed into a given pattern in a given space.

The present inventors have found, however, that a heating element can be formed into a convoluted waveform to change the axial length of the element without changing its surface length. Thus the effective length of the element can be changed to suit the designer's needs without changing the heating properties of the element. This gives a designer increased flexibility in designing heat output patterns and allows patterns to be formed that were heretofore impossible to form in heating units having certain characteristics. The formula:

$$L_{ab}=\frac{\pi(2r-T)}{90}\left(90+\tan^{-1}\left(\frac{2(H-2r)}{P}\right)-\cos^{-1}\left(\frac{2(2r-T)}{\sqrt{4(H-2r)^2+(P)^2}}\right)\right)+\sqrt{4(H-2r)^2+P^2-4(2r-T)^2}$$

where

H=the amplitude of the wave;

T=the thickness of the heating element;

P=the pitch of the waveform r=the outside radius of curvature of the element; and, $L_{ab}$=the axial length of the element, defines the relationship between the developed length of waveform and its wavelength or pitch P, its amplitude or height H, its thickness T, and the radius of curvature r of the curved portions of the waveform. By selecting appropriate values for the pitch and amplitude of a waveform, the axial length of a heating element can be varied over a wide range without affecting the resistance of the heating element.

In practice, the radius of curvature r and the pitch P of the waveform are determined by the device used to bend the element and can therefore be treated as fixed values. The axial length is based on the length of the pathway into which the element is to be fitted and this must be held constant; likewise, the thickness of the element cannot easily be varied. Therefore, the preferred method of forming a waveform having a desired axial length from an element having a given surface length is to fix all these variables and then determine the amplitude that that waveform must have in order to satisfy the above equation.

Unfortunately, it is difficult if not impossible to solve the above equation directly for amplitude in terms of the other variables. Therefore, the inventors have developed the following iterative method of determining the surface length of each wavelet in the needed waveform, successively estimating waveform amplitudes, determining the wavelet surface length that will be produced by a given estimated amplitude, and adjusting the amplitude and recalculating the resultant wavelet surface length until the calculated waveform surface length is sufficiently close to the desired wavelet surface length.

Figure 6:
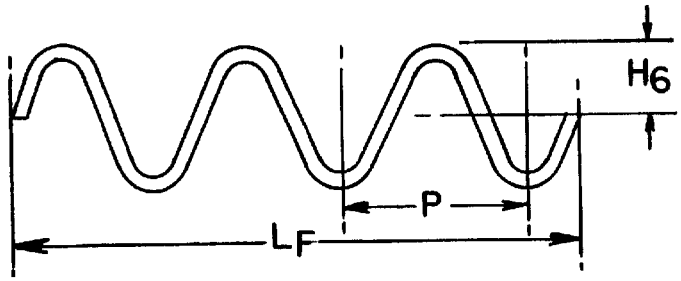
FIG. 6 is a side elevation view of a second portion of heating element material having a second surface length formed into a waveform having a given wavelength and axial length.
Figure 7:
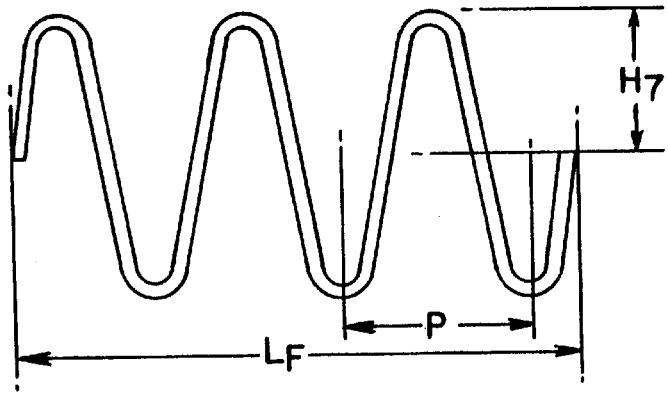
FIG. 7 is a side elevation view of a third portion of heating element material having a third surface length formed into a waveform having the same wavelength and axial length as the waveform shown in FIG. 6.

The desired final or axial length $L_F$ of the element is known, and the wavelength or pitch P of the waveform is known from the characteristics of the forming equipment being used. Therefore, the number of wavelets N in the final waveform can be determined by dividing $L_F$ by the pitch P. The surface length of each wavelet, $L_S$ is then calculated by dividing the surface length of the entire element L by the number of wavelets N. With the pitch P, radius of curvature r, and wavelet surface length $L_S$ known, the process of calculating the amplitude of the waveform can begin. It will be appreciated from FIGS. 6 and 7 that an element of any initial length can be bent into a waveform having an axial length $L_F$ and a fixed wavelength merely varying the amplitude of the waves. The axial lengths $L_F$ of the waveforms in these figures are equal, but it can be seen that the amplitude $H_7$ of the waveform in FIG. 7 is greater than the amplitude $H_6$ of the waveform in FIG. 6.

Figure 12:
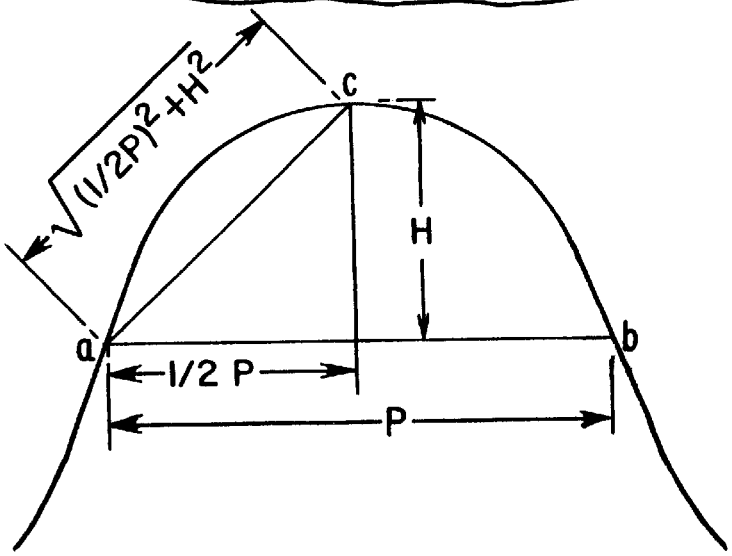
FIG. 12 is a schematic side elevation view of a wavelet in two dimensions showing the relationships between the pitch, amplitude and surface length of the wavelet.

The process of estimation begins by calculating a first estimate of the height H of the wavelets based on the known information. As shown in FIG. 12, the height of a wavelet having endpoints a and b can be approximated by bisecting the line connecting a and b with a perpendicular line which intersects the wavelet at point c. Next, point c is connected to point a to form a triangle having one side equal to one half of the wavelength and one side equal to the height H of the wavelet. By the Pythagorean relationship for a right triangle, the length of the line connecting point a and point c, the hypotenuse of the triangle, is equal to the square root of the sum of the squares of H and ½ P. The actual surface length of the wavelet between points a and c is known. Therefore, the length of line a-c is approximately equal to ½ $L_{ab}$. Using ½ $L_{ab}$ as an estimate of the length of the hypotenuse of the triangle, and the known value of ½ P for the length of one of the legs, a first estimate of the height H of the wavelet can be calculated by solving the Pythagorean equation for H. Specifically, $$H=\sqrt{(+e,\text{fra } 1/2L_{ab})^2-(½P)^2+ee}$$

This estimated value of H is then plugged into equation 1 and the equation is solved for $L_{ab}$. The straight line between points a and c represents the shortest distance between these two points, and therefore, the actual height H of the waveform will always be less than or equal to the first estimated value of H. The estimated value is compared to the known value for $L_{ab}$ and if it is higher than $L_{ab}$, a second estimated value for H is obtained by decreasing the first estimate of H by a given amount such as one unit, or by a given percentage, such as 10 percent. This value for H is plugged into the equation and the estimation process is repeated until the estimated value of H produces a value for $L_{ab}$ that is less than the known value. The actual value for H will lie somewhere between the last value for H that produced too high a value for $L_{ab}$ and the first value for H that produced too low an estimate. This range for H can be repeatedly divided and new values for $L_{ab}$ calculated until an H is found that produces an $L_{ab}$ that differs from the actual $L_{ab}$ by less than a given amount, such as 5 percent. When the calculating steps are carried out by a computer, numerous estimates can be obtained in a short period of time, to produce a very accurate estimate for H. By repeating this process, the value for H can be calculated to any degree of accuracy; however, the precision of the waveform forming machine will limit the degree of accuracy necessary.

Figure 9:
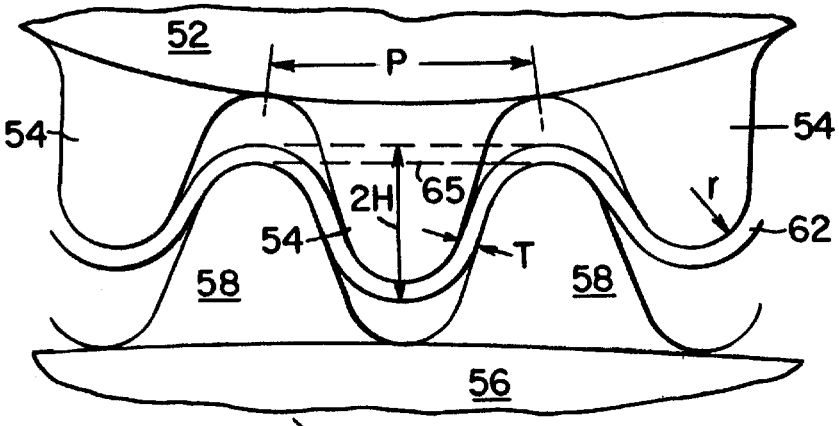
FIG. 9 is a detail view of a portion of the device shown in FIG. 8.
Figure 8:
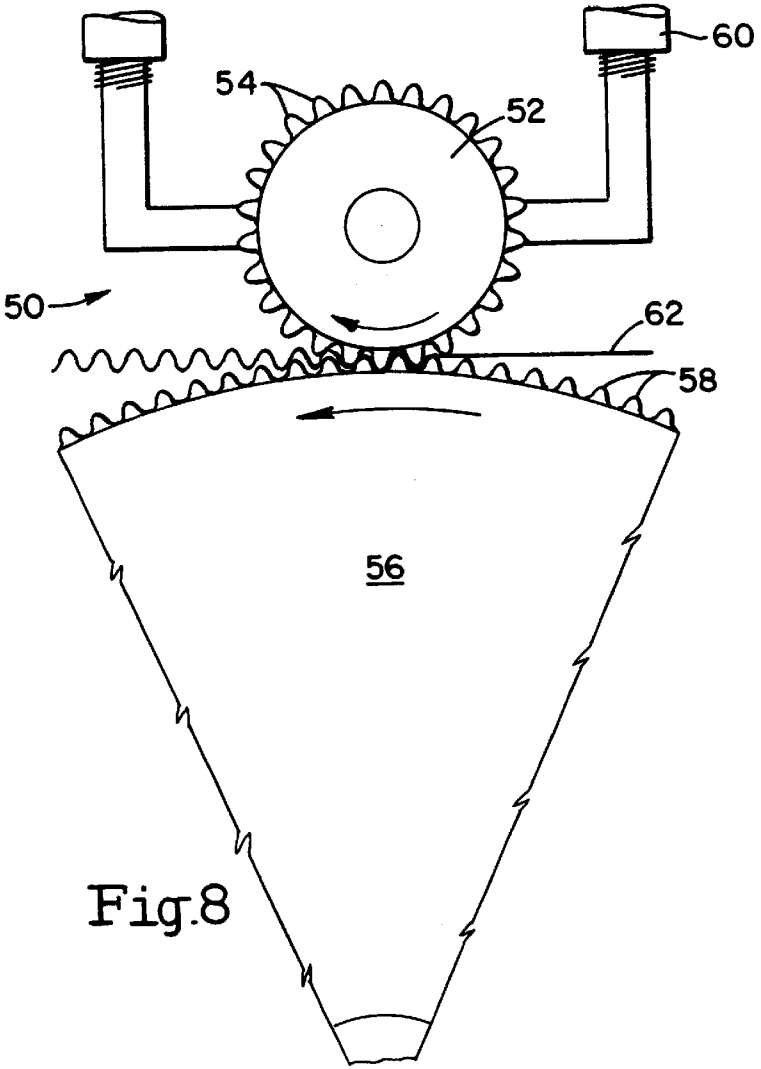
FIG. 8 is a side elevation view of a first device for forming a heating element into a waveform.

Once an acceptable value for H has been calculated, a device such as machine 50 shown in FIG. 8 can be used to produce a ribbon having a desired waveform. Forming machine 50 comprises a first gear wheel 52 having teeth 54 and a second gear wheel 56 having teeth 58. Preferably, the diameter of second wheel 56 is at least twice the diameter of first wheel 52 to ensure that the teeth of the wheels engage in a gradual manner. The radius of curvature of the ends of teeth 54 and 58 is r minus T, and the pitch of the teeth on both wheels is P. The wheels are positioned so that teeth 54 of first wheel 52 intermesh with teeth 58 of wheel 56, and the relative spacing of the wheels is adjusted using controller 60. When a length of heating element material 62 is inserted between the wheels and the wheels are turned by a drive, not shown, the material will be bent into a waveform as it is pressed between the intermeshing teeth. The amplitude or height of each wavelet in the waveform is determined by the spacing between the wheels. As seen in FIG. 9, if a line 64 is drawn between the outermost portions of two adjacent teeth 58 on wheel 56 for example, the distance between this line and the outermost portion of the tooth 54 from wheel 52 that falls between these two teeth 58, plus twice the thickness T of the ribbon, will be equal to twice the amplitude of the waveform. Controller 60 allows for precise adjustment of the separation of wheels 52 and 56.

Figure 10:
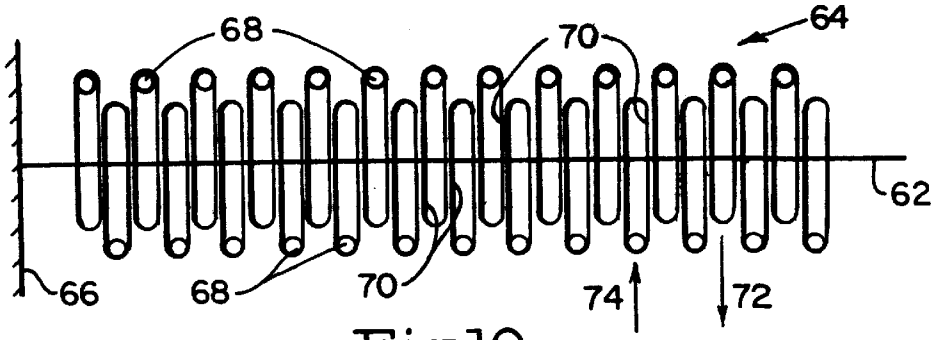
FIG. 10 is a side elevation view of a second device for forming a heating element into a waveform.
Figure 11:
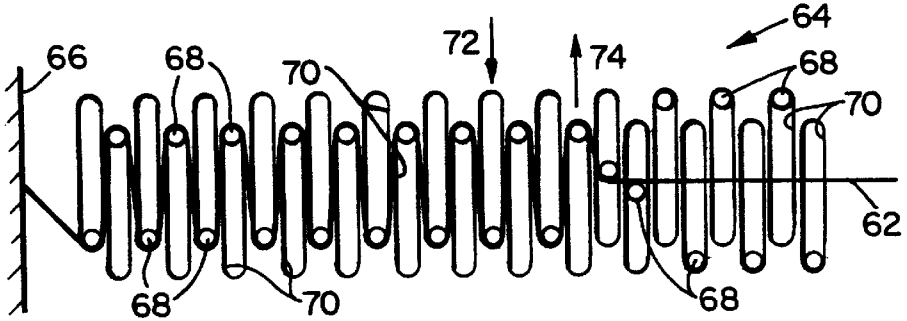
FIG. 11 is a side elevation view of the device shown in FIG. 10 being used to form the portion of heating element material shown in FIG. 10 into a waveform.

When the height H of a given waveform is significantly greater than the pitch P of the waveform, it is preferable to use a forming machine such as device 64 shown in FIG. 10. This forming device comprises a holder 66 for holding a first end of heating element 62, and a plurality of forming pins 68 individually and slidingly disposed in a plurality of parallel channels 70, perpendicular to the element, the centerlines of which channels are separated by a distance equal to the pitch of the desired waveform. The radii of the pins determines the radius r of the waveform. The pins are positioned equal distances from element 62 on alternating sides of the element, and then moved sequentially, using a suitable actuating device (not shown), starting at the end of the element closest to the holder 66 against element 62 to form individual wavelets. The pin in the first slot is caused to slide along the first slot in direction 72 until it contacts the element and pushes the surface of the element opposite from the pin away from the pin's original position by a distance of H. The next pin in the series is then caused to move against element 62 from the opposite side of the element in direction 74 opposite from direction 72 and push a portion of element 62 away from its original position by a distance equal to H. This process continues until the entire element has been formed into the appropriate waveform. Element 62 is then released from holder 66 having the height, wavelength and radius of curvature that were determined to be needed in order to fit the element into a given pathway.

Once formed, the heating element 62 can be connected to substrate 44 along pathway 46 in a number of different manners. For example, the substrate may be in a semi-solid state that will allow the element to be pressed into the substrate and left to harden in place as the substrate cures. Alternately, a small channel can be formed in the substrate and the element placed therein and secured in a suitable fashion. These and other methods of attaching the element to the pathway can be used without departing from the scope of the invention.

Figure 13:
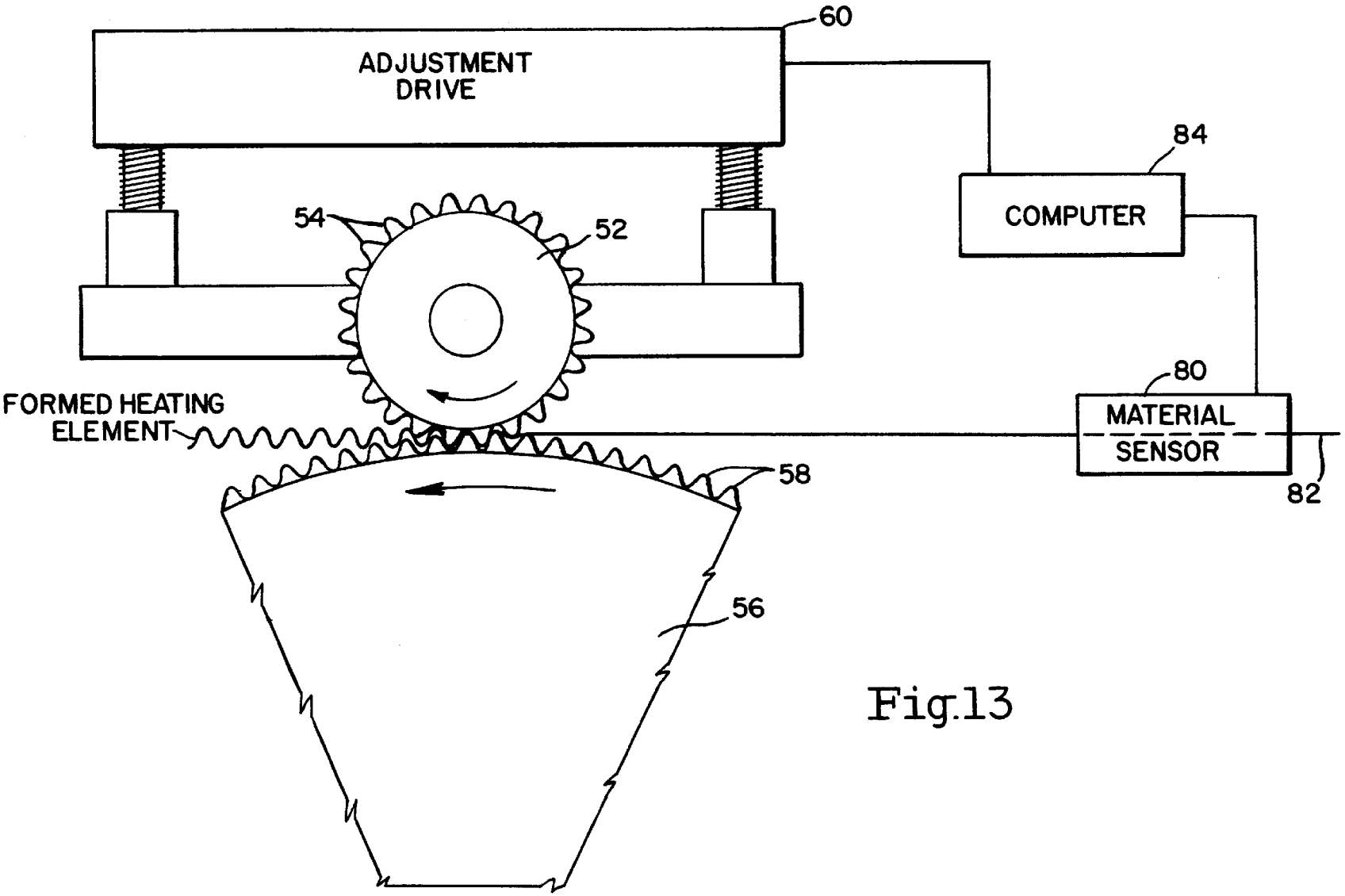
FIG. 13 is a side elevation view of a further embodiment comprising the device of FIG. 8 arranged with a controller for automatically controlling the waveform based on the measured material resistance.

Referring to FIG. 13 another embodiment of the invention will be described. The FIG. 13 embodiment includes the apparatus of FIG. 8, in a further arrangement comprising a resistance measurement or sensor unit 80 for measuring the resistance of the unformed ribbon 82, and a variable spacing controller 84 for controlling the spacing of the gear wheels 52 and 56, closer or further to obtain a wave amplitude $H_{mod}$ which is larger or smaller than the H value calculated as described above, based on the measured resistance of the ribbon 82. This embodiment provides manufacture of heating elements having a constant predetermined resistance R, with a constant overall axial length, regardless of variations in the actual resistance per unit length of the ribbon 82.

More particularly, when a heating element manufacturer purchases the heating element ribbon from its material supplier or vendor, the desired resistance per unit length is specified together with the acceptable tolerance for deviations from that value. A tolerance must be given, due to cost considerations and the processing limitations of the vendor. Accordingly, in the related art a compromise must be reached, with the acceptable variation in resistance per unit length corresponding to the acceptable variation in the wattage of the heating element. The compromise frequently increases cost over that obtainable if higher variations in wattage were acceptable, while at the same time increases the unit-to-unit variation in wattage over that preferred if cost were not a factor. The embodiment of FIG. 13 solves this problem.

Referring to FIG. 13, the unformed ribbon 82 passes through the resistance measurement unit 80 prior to passing between the teeth of the gear wheels 52 and 56 for corrugation. The resistance measurement unit 80 is a conventional resistance instrument, of the type available from various vendors, using readily available graphite probes for reduced friction and wear. The nominal spacing of the gear wheels 52 and 56 is set to form the ribbon to have corrugation amplitude H, calculated as described above, which achieves the desired resistance if the ribbon 82 possesses the exact value of resistance per unit length $R_{spec}$ for which H was calculated. The measurement unit 80 continuously monitors the resistance $R_{meas}$ of the ribbon and generates a signal $S_{meas}$ which is input to the controller 84. If $R_{meas}$ is exactly equal to $R_{spec}$ then $S_{meas}$ drives the gear wheels 52 and 56 to the spacing corresponding to the nominal amplitude H. However, if $R_{meas}$ deviates from $R_{spec}$ then $S_{meas}$ drives the gear wheels 52 and 56 to a position which increases or decreases the amplitude of the corrugation waves $\Delta H$ from H to obtain the compensated value $H_{mod}$. Therefore, when the ribbon 82 enters the meshed teeth 52 and 58 of the wheels 52 and 56 it is corrugated according to the process described in reference to FIG. 8 to have an amplitude $H_{mod}$ and, hence, an actual path length longer or shorter than that obtained with H, and then cut to the predetermined overall physical length. The overall physical (axial) length is preset in accordance with the heating unit (not shown) into which the element will be installed.

Accordingly, with the embodiment of FIG. 13 the wattage of the finished heating element is automatically maintained at a near constant value, and the element has a constant and predetermined physical length, regardless of batch-to-batch deviations in the resistance of the ribbon 82. A further benefit of this embodiment is that the acceptable tolerance in the resistance per unit length of the ribbon 82 may be substantially larger than the tolerance which would be acceptable without the continual resistance monitoring and gear adjustment performed by units 80 and 84. Therefore, the embodiment of FIG. 13 improves both the consistency and cost of the product.

The invention has been described in terms of two preferred methods, it being understood that other methods of forming an heating element into a desired waveform will become apparent to those skilled in the relevant art upon a reading and understanding of this specification. For example, it is possible to form a heating element having a fixed height and an axial length that is shorter than what is needed for a given application. The pitch of each wavelet in the waveform can then be increased by a sufficient amount, such as by inserting a small wedge into each wavelet, to produce an element having the desired overall length. It is intended that all such methods of fitting a heating element of fixed length into pathways having various lengths be included within the scope of this application to the extent that they are defined by the several claims appended hereto.

I claim:

1. A method for forming a ribbon to have a predetermined resistance and a predetermined axial length dimension, comprising steps of:

selecting a corrugation waveform;

selecting a corrugation wavelength;

selecting a resistance value;

selecting a nominal resistance per unit length;

selecting a ribbon having a resistance per unit length substantially equal to said nominal resistance per unit length;

determining a nominal amplitude of the corrugation based on said selected corrugation wavelength, said selected corrugation waveform, and said nominal resistance per unit length, such that a resistance across said predetermined axial length is calculated to be substantially equal to said resistance value;

measuring a resistance per unit length of a length said selected ribbon;

determining an adjusted amplitude of the corrugation based on a difference between a result said measuring step and said nominal resistance per unit length; and forming a length of said selected ribbon into a form having said selected corrugation waveform, said corrugation wavelength and said adjusted amplitude, and said predetermined axial length dimension.

2. The method of claim 1 wherein said waveform is comprised of a plurality of substantially identical wavelets.

3. The method of claim 1 wherein said waveform includes radiused portions and including the additional step of selecting a radius of curvature for said radiused portions.

4. The method of claim 1 wherein the step of forming said ribbon into a waveform comprises the step of passing said ribbon between the teeth of two closely spaced gears the teeth of said gears intermeshing by a distance corresponding to said determined adjusted amplitude of the corrugation.

5. The method of claim 4 wherein said ribbon has a thickness and said distance is approximately twice said amplitude minus twice said thickness.

6. An apparatus for forming a heating element to have a predetermined resistance and a predetermined axial length dimension, comprising:

means for measuring a resistance per unit length of a length of a ribbon of resistive material and for generating a measurement signal in response; and means for forming a length of said ribbon into a form having a predetermined corrugation wavelength and a corrugation amplitude, said corrugation amplitude based on a predetermined nominal resistance per unit length value, said measurement signal, said predetermined axial length dimension, and said predetermined resistance, wherein said means forms said corrugation amplitude such that said heating element has said predetermined axial length dimension and a resistance across said predetermined axial length dimension substantially equal to said predetermined resistance.

7. An apparatus according to claim 6, wherein said means for forming a length of said ribbon comprises:

a first gearwheel having a plurality of gear teeth rotatably supported on a first axle;

a second gearwheel mounted on a second axle parallel to said first axle and having a plurality of gear teeth intermeshed with said gear teeth of said first wheel;

a controller for controlling a separation between said first axle and said second axle based on based on a predetermined nominal resistance per unit length value, said measurement signal, said predetermined axial length dimension, and said predetermined resistance; and drive means for rotating at least one of said first and second gearwheels, whereby said ribbon is inserted between the intermeshing teeth of said first and second gearwheels is drawn therebetween and bent into a waveform.

8. The apparatus of claim 7 wherein the tooth pitch of said first gearwheel is approximately equal to the tooth pitch of said second gearwheel.

9. The apparatus of claim 8 wherein the diameter of said second gearwheel is at least twice as large as the diameter of said first wheel.

* * * * *